US005222890A

United States Patent [19]

Payr

[11] Patent Number: 5,222,890

[45] Date of Patent: Jun. 29, 1993

[54] DEVICE FOR THE SAGGER-LESS BURNING OF CROCKERY

[75] Inventor: Hans Payr, Röttenbach, Fed. Rep. of Germany

[73] Assignee: Norton Company, Worcester, Mass.

[21] Appl. No.: 360,629

[22] Filed: Jun. 1, 1989

[30] Foreign Application Priority Data

Jun. 3, 1988 [DE] Fed. Rep. of Germany ..... 3818854

[51] Int. Cl.[5] ..... F27D 5/00

[52] U.S. Cl. ..... 432/259; 432/258

[58] Field of Search ..... 432/258, 259, 253; 264/57-59; 34/239

[56] References Cited

U.S. PATENT DOCUMENTS

| | | | |
|---|---|---|---|
| 46,109 | 1/1865 | Jackson | 432/259 |
| 1,941,941 | 1/1934 | Irwin | 432/259 |
| 2,208,734 | 7/1940 | Schreiber | 432/259 |
| 2,263,212 | 11/1941 | Irwin | 432/259 |
| 3,861,867 | 1/1975 | Owhl | 432/259 |
| 4,362,507 | 12/1982 | Antonucci | 432/259 |
| 4,636,170 | 1/1987 | Stupka | 432/259 |
| 4,792,301 | 12/1988 | Pan | 432/6 |
| 4,919,614 | 4/1990 | Kitagawa et al. | 432/258 |

*Primary Examiner*—Henry C. Yuen
*Attorney, Agent, or Firm*—Arthur A. Loiselle, Jr.

[57] ABSTRACT

The present invention relates to a device for the sagger-less burning of crockery comprising setting plates (2) and individual supports (1) which are designed as separate components from the setting plates (2), each printer's bit (2) being supported by two individual supports (1) and the ratio of the number of setting plates to the number of individual supports being 1:1.

8 Claims, 2 Drawing Sheets

DEVICE FOR THE SAGGER-LESS BURNING OF CROCKERY

The invention relates to a device for the saggerless burning of crockery, in particular porcelain and ceramic plates in tunnel kilns, shuttle kilns and chamber kilns as well as in rapid-burning kilns with one or more burning levels.

The burning of flat crockery in a tunnel kiln is nowadays carried out in so-called economy saggers, in which the plates are burned at temperatures of about 1400° C. The weight of the saggers generally amounts to 5 to 8 times the weight of the crockery to be burned. This weight is a significant reason for the fact that over 7,000 kcal/kg are required for burning porcelain plates while the theoretical heat requirement is only 10% of this value. In addition, there is the fact that the loading and unloading of the saggers is very labourintensive since the saggers have in each case to be unstacked and restacked.

German Offenlegungsschrift 2.817,887 discloses kiln furniture in which setting plate and feet are separate components. For this purpose, three feet are always required per setting plate, specially designed printer's bits having three lugs being used through which the correspondingly shaped ends of the individual supports are passed. Thus, in this system the ratio of the number of setting plate to the number of supports is not 1:1, more supports always being required than setting plate. An optimum utilization of space can only be achieved if the individual setting plate are arranged in an irregular pattern. For this reason, however, the device is not suitable for automatic placement of the kiln furniture. It is likewise impossible to arrange the individual levels on a framework, with the result that it is not possible to remove individual levels of setting plates; i.e. the stacks can only be removed as such. Finally, the bores through which the individual supports are passed entail a hindering of thermal expansion; i.e. relatively narrow tolerances of the bores are demanded, signifying increased expenditure on production.

German Offenlegungsschrift 3,006,376 is to be seen in close conjunction with German Offenlegungsschrift 2,817,887 for here setting plates likewise provided with three lugs are used. The special feature lies in the proposal that one support be used for in each case two lugs of two different setting plates. Thus, with this system too, a ratio of the number of individual supports to the number of setting plates of 1:1 is not achieved, more supports always being present than setting plates.

German Offenlegungsschrift 2,351,691, which is also cited by the examiner, relates to kiln furniture in which supports and placement surfaces form one component. Thus, with this system too, a ratio of the number of printer's bits to the number of individual supports of 1:1 cannot be achieved upon stacking.

It is an object of the invention to make available a device for the sagger-less burning of crockery comprising setting plates and individual supports which are designed as separate components from the setting plates, which device permits a further-optimized utilization of space in the kiln. At the same time, the weight of the device should be minimized. Finally, the intention is, by means of the device according to the invention, to accelerate the loading and unloading of the shuttle and, if possible, even automation of said procedure.

This object is achieved by the fact that each setting plates is supported by two individual supports and the ratio of the number of setting plates to the number of individual plates is 1:1. At their upper side and underside, the individual supports are preferably shaped such that they act as a joint surface when a plurality of supports is stacked one above the other. For this purpose, said supports are preferably provided with locking projections and depressions. The individual supports can furthermore have recesses for the setting plates. These recesses are designed such that the thermal expansion behaviour of the setting plates is not hindered. In cross-section, the individual supports can have various geometrical shapes. Triangular, circular, angular, square or rectangular configurations are preferred. At the same time, the side faces can also be curved.

The faces of the setting plates are matched to the size of the particular material to be burned. Preferably, this matching is effected only in the central part of the placement surface while, at the ends, the placement surfaces can be of narrow design and shaped such that they can be inserted into the recesses of the individual supports. By means of this mode of construction, an optimum weight saving is achieved. The number of supports of the device according to the invention can be matched to the particular requirements, one setting plates always being supported by two supports and the ratio of individual supports to setting plates in one plane always being 1:1. Accordingly, the device must comprise at least three setting plates and three individual supports. Preferably, the devices according to the invention comprise three to six setting plates and three to six individual supports in one plane. According to the invention, a device is particularly preferred in which three or four setting plates can be placed on three or four individual supports.

The advantage as compared to the devices known from German Offenlegungsschrift 2,817,887, 3,006,376 and 2,351,691 is that the number of the supports corresponds to that of the placement surfaces where more than three setting plates are used. Consequently, only three supports are now required for three placement surfaces or four supports for four placement surfaces, whereas in the prior art indicated at least six or eight supports, respectively, would be necessary. The consequence of this is a considerable weight saving compared to the hitherto known devices. The weight saving increases with the number of setting plates inserted into the kiln. By virtue of the fact that the individual supports are shaped such that they can be fitted one above the other, a plurality of placement levels can be arranged one above the other. For the construction of two placement levels for in each case four plates, a total of eight supports is needed. This results in considerable weight savings, even where a plurality of placement levels is constructed where the device according to the invention is used. It is surprising that, despite the use of only two individual supports per placement surface, the device according to the invention has a greater stability than the systems known from the prior art for the construction of a plurality of placement levels.

By an appropriate arrangement in the system of the material to be burned, the burning-space capacity can be optimally used. The individual elements of the system are variable and can always be matched to the requirements imposed by the material to be burned. In comparison to the cited prior art, an up to 25% higher space utilization is made possible.

As a further advantage there is in addition the fact that the device according to the invention can also be placed on a framework, because, as a consequence of its design with only two individual supports per setting plates, the system is suitable for a symmetrical manner of placement. Construction on frames makes it possible for individual parts of the structure to be removed for loading and unloading.

In particular, it is possible without great expenditure for the placement surfaces to be exchanged, so that only those are used which are matched to the particular size of the material to be burned. The system can furthermore be constructed on various shuttles via placement frames and various placement surfaces The burning space available can thus be used several times vertically. The material to be burned can be inserted and removed from various sides. Finally, the geometrical configuration of the setting plates has the advantage that setting plates sagging on the placement surface is largely avoided, even in the case of minimum setting plates thicknesses. At the same time, it prevents an alteration of the planimetry in the placement region of the material to be burned. The device according to the invention can be employed in a very wide variety of kiln systems. Depending on the use and selection of the ceramic materials for the elements of the device according to the invention, said device can be employed at temperatures of up to 1700° C.

The device according to the invention makes possible a placement pattern having regular lines and points with simultaneous optimum space utilization. Since, in addition, the material to be burned can be easily inserted and removed, the device according to the invention also fulfils the conditions for automated insertion and removal.

The individual elements of the device according to the invention are produced essentially from recrystallized SiC, nitride-bonded SiC and mullite-bonded SiC and $Al_2O_3$. These products are available commercially under the names Crystar®, Cryston® and Mulnorite®. Among the technical ceramic grades having special properties and suitable for the present invention are, in addition, conventional bonded silicon carbide and silicon-infiltrated silicone carbide grades.

The geometrical shaping of the elements of the device according to the invention and the selection of the suitable technical ceramic grade make possible optimized utilization of the burning space and a variable configuration of the placement space. Of particular advantage according to the invention is the possibility of carrying out operations using the minimum possible kiln furniture weights. The device according to the invention is thus also suitable for rapid-burning conditions. The thicknesses of the setting plates correspond approximately to the thicknesses of the material to be burned. A uniform temperature distribution over the cross-section of the material to be burned and an increase in the surface quality of the material to be burned is thereby guaranteed.

The invention is explained in greater detail below with reference to the drawings.

Figure 3:
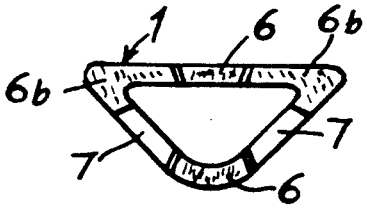
FIG. 3 shows a triangular support in cross-section.
Figure 3A:
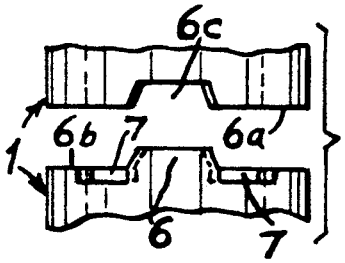

FIG. 3*a* shows embodiments of the surfaces of the upper side and underside of the support.

Figure 3B:
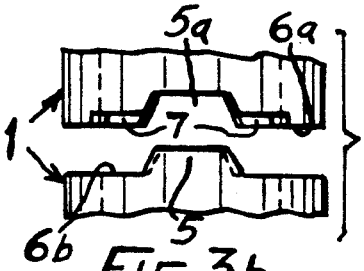

FIG. 3*b* shows a further embodiment of the upper-side face and underside face of the support.

Figure 4:
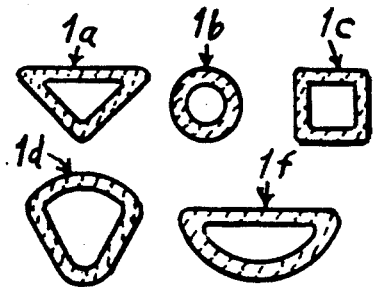

FIG. 4 shows various geometrical shapes of supports.

Figure 5:
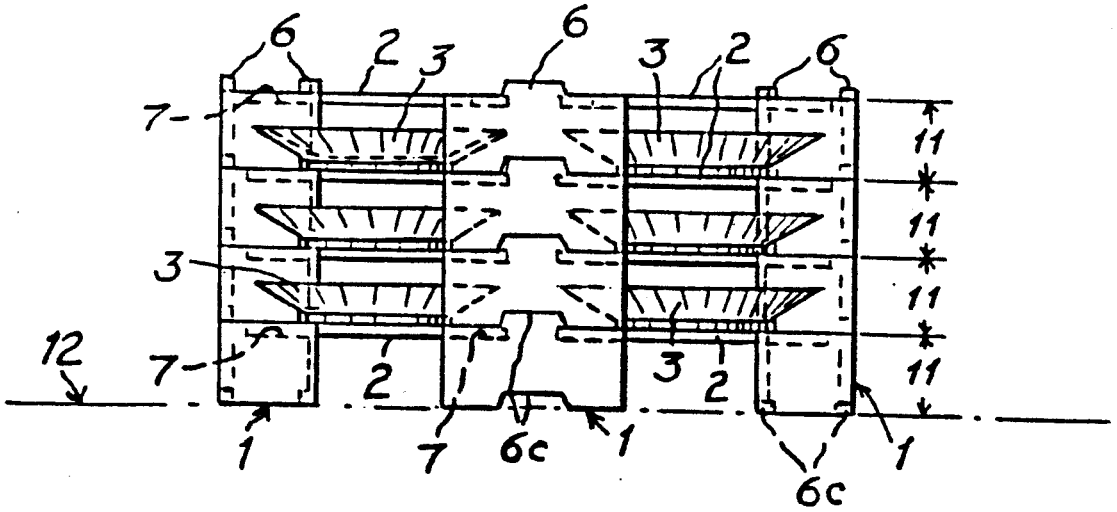

FIG. 5 shows the structure of the device according to the invention in a kiln, with a plurality of placement surfaces one above the other.

Figure 6:
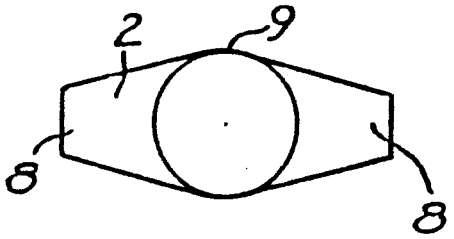
Figure 7:
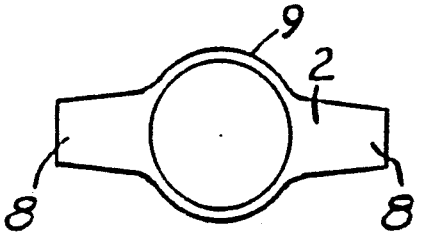

FIGS. 6 and 7 show geometrical shapes of placement surfaces.

Figure 6A:
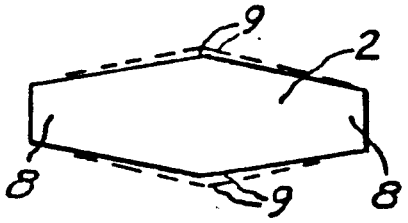
Figure 7A:
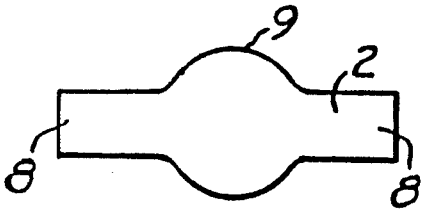

FIGS. 6A and 7A depict two additional examples of setter plates shapes.

Figure 1:
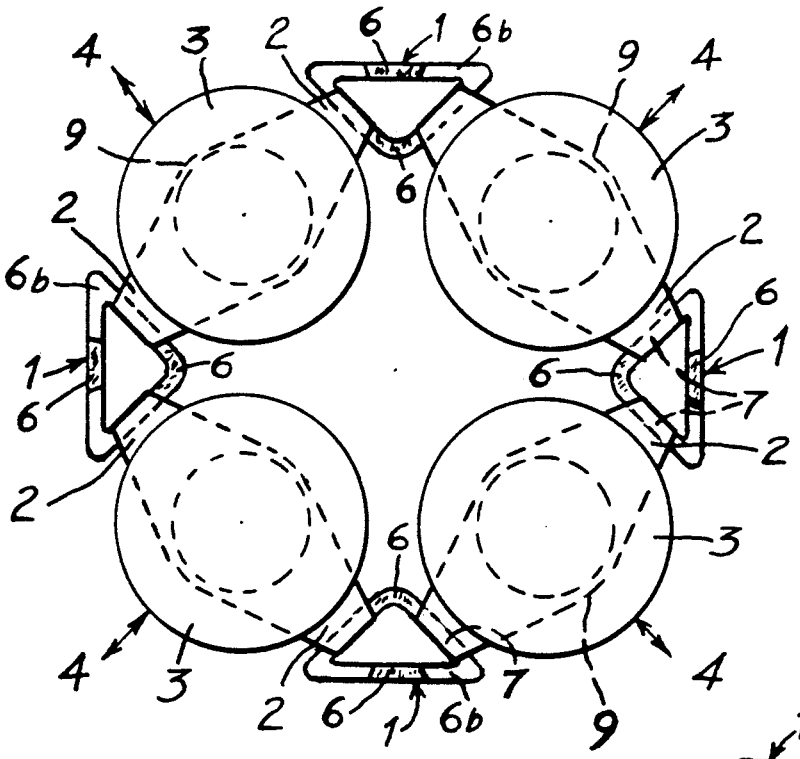
FIG. 1 shows a device comprising four individual supports and four setting plates.

FIG. 1 illustrates an embodiment which is preferred according to the invention and in which four setting plates 2 rest on four individual supports 1. The plates 3 to be burned are situated on the setting plates 2. The width of the central part 9 corresponds to the diameter of the bearing surface of the plates 3. Towards both ends, the width of the setting plates 2 tapers. The plates 3 can be removed at the sides 4.

Figure 2:
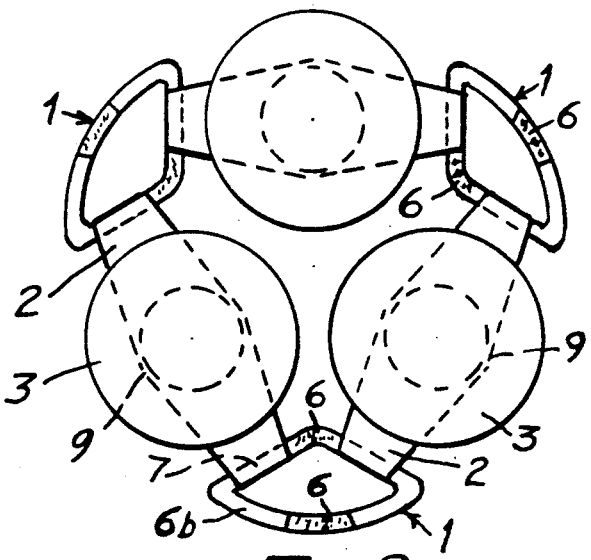
FIG. 2 shows a device comprising three supports and three setting plates.

FIG. 2 shows a further preferred embodiment of the device according to the invention, in which three setting plates 2 rest on three individual supports 1. The shape of the setting plates 2 and of the plates 3 corresponds to the design illustrated in FIG. 1.

A design, which is preferred according to the invention, of a support is illustrated in cross-section in FIG. 3. This support has the shape of a triangle. The locking arrangements 5 and the recesses 6 serve for the positive, displacement-proof placement of the supports one above the other upon assembly of a plurality of setting plates. Thus, the locking projection 6 is precisely matched to the recess 6*c*. The same applies to the locking projection 5 and the recess 5*a*. By virtue of this shape of the design, the upper surface (6*b*) and lower surface (6*a*) can be placed one upon the other in such a way that they act as a displacement-proof joint surface. As a result, a plurality of supports can be placed one above the other without the risk of slipping or any other instability. Using the setting plates 2 inserted into the recesses 7, it is possible to arrange a large number of placement levels one above the other without the danger of instabilities. In principle, the burning kilns conventional today can be filled over their entire cross-section with the aid of the device according to the invention.

Various geometrical shapes of the supports 1 are shown in cross-section in FIG. 4. The triangular, circular, square and rectangular shapes 1*a*, 1*b*, 1*c* are particularly preferred. The shapes 1*d* and 1*f* which are rounded at the side faces can also be employed. FIGS. 6 and 7 illustrate the geometrical shapes of the setting plates 2 according to the invention. The shape illustrated in FIG. 6 is particularly preferred since here, on the one hand, the setting plates 2 and the size of the material to be burned are optimally matched to one another and, on the other hand, setting plates sagging is prevented. An optimum weight saving is achieved in the case of the shape illustrated in FIG. 7. In the case of both shapes, the ends 8 which are inserted into the recesses 7 of the supports 1 are considerably smaller than the placement surface 9 matched to the material to be burned.

Finally, in FIG. 5, the cross-section of a kiln is shown in which the device according to the invention is accommodated. The number of setting plates 2 is determined solely by the placement height 11. The placement height 11 depends in turn on the height of the material to be burned. The supports 1 can, if required, be varied depending on the height of the material to be burned. By virtue of the device according to the invention, the kiln can be filled over its entire width and height with material to be burned.

I claim:

1. Device for the sagger-less burning of crockery comprising setting plates (2) and individual supports (1) which are designed as separate components from the setting plates (2), characterized in that each setting plates (2) is supported by two individual supports (1).

2. Device according to claim 1, characterized in that the individual supports (1) are provided with recesses (7) for the setting plates (2).

3. Device according to one of claims 1 or 2, characterized in that, in cross-section, the individual supports (1) are of triangular (1*a*), circular (1*b*), angular, square or rectangular (1*c*) configuration.

4. Device according to claim 1, characterized in that it comprises three setting plates (2) and three supports to six setting plates (2) and six supports in one plane.

5. Device according to claim 4, characterized in that it comprises four individual supports (1) and four setting plates (2) in one plane.

6. Device according to claim 4, characterized in that it comprises three individual supports (1) and three setting plates (2) in one plane.

7. Device according to claim 1, characterized in that individual supports and setting plates are arranged one above the other in a plurality of planes (11), the surfaces of the underside (6*a*) of the individual supports (1) being placed on the surfaces of the upper side (6*b*) of the individual supports (1) situated below the latter.

8. Device according to claim 7, characterized in that the surfaces on the upper side (6*b*) and underside (6*a*) of the individual supports (1) are provided with locking projections (6) and depressions (6*a*, 5*a*) which act as displacement-proof joint surface of the individual pieces (1) placed on one another.

* * * * *